US009463558B2

(12) United States Patent
Yang

(10) Patent No.: US 9,463,558 B2
(45) Date of Patent: Oct. 11, 2016

(54) HAND TOOL

(71) Applicant: Hsin-Hung Yang, Taichung (TW)

(72) Inventor: Hsin-Hung Yang, Taichung (TW)

( * ) Notice: Subject to any disclaimer, the term of this patent is extended or adjusted under 35 U.S.C. 154(b) by 265 days.

(21) Appl. No.: 14/256,068

(22) Filed: Apr. 18, 2014

(65) Prior Publication Data

US 2014/0318327 A1 Oct. 30, 2014

(30) Foreign Application Priority Data

Apr. 24, 2013 (TW) ..... 102207466 U

(51) Int. Cl.
*B25B 23/00* (2006.01)

(52) U.S. Cl.
CPC ..... *B25B 23/0035* (2013.01)

(58) Field of Classification Search
CPC ... B25B 23/00; B25B 23/0035; B25B 13/06; B25B 13/065; B25B 13/102
USPC ..... 81/437, 124.5
See application file for complete search history.

(56) References Cited

U.S. PATENT DOCUMENTS 1,323,056 A * 11/1919 Hoffmann ..... B25B 13/48 7/138
1,626,730 A * 5/1927 Haynes ..... B25B 13/06 81/124.5
4,798,111 A * 1/1989 Cheeseman ..... B25B 13/56 81/124.4
8,196,495 B2 * 6/2012 Chen ..... B25B 13/06 81/125

* cited by examiner

*Primary Examiner* — Hadi Shakeri
(74) *Attorney, Agent, or Firm* — Rabin & Berdo, P.C.

(57) ABSTRACT

A hand tool has a tool shaft, an inner sliding sleeve, an engagement module, and an outer sliding sleeve. The inner sliding sleeve is mounted around the tool shaft and is selectively engaged with the tool shaft. The engagement module has a spring mounted around the inner sliding sleeve. The outer sliding sleeve is mounted around the inner sliding sleeve, abuts the spring and selectively engaged with the inner sliding sleeve. The hand tool is applied for connecting with an inner polygonal bolt or an outer polygonal bolt.

3 Claims, 5 Drawing Sheets

HAND TOOL

BACKGROUND OF THE INVENTION

1. Field of the Invention

The present invention relates to a hand tool, and more particularly to a hand tool with multiple applications for various types of nuts and bolts.

2. Description of Related Art

A conventional hand tool is applied for tightening or loosening a bolt or a nut, and is generally applied for a particular type of bolt or nut, such as an inner square bolt. When the hand tool is applied for another type of bolt or nut, such as an outer hexagonal bolt, the hand tool has to be connected with an adapter sleeve.

To resolve the inconvenience of using the hand tool, a hand tool with a sliding sleeve is provided. The hand tool has a tool body and a sliding sleeve slidably mounted around the tool body. When the sliding sleeve is slid to be retracted relative to the tool body, the tool body can be connected with an inner hexagonal bolt. On the other hand, when the sliding sleeve is slid and the tool body is retracted relative to the sliding sleeve, the sliding sleeve can be connected with an outer hexagonal bolt. However, the sliding sleeve is not positioned relative to the tool body, and is slid easily to interfere with the operation of the user.

SUMMARY OF THE INVENTION

The main objective of the present invention is to provide a hand tool to resolve the afore-mentioned problems.

The hand tool has a tool shaft, an inner sliding sleeve, an engagement module, and an outer sliding sleeve.

The tool shaft has a working segment and an engaging recess formed in the working segment.

The inner sliding sleeve is slidably mounted around the working segment, is selectively positioned relative to the working segment, and has an engaging hole and an engaging ball. The engaging hole is formed through the inner sliding sleeve and selectively aligned with the engaging recess. The engaging ball is moveably mounted in the engaging hole.

The engagement module is mounted around the inner sliding sleeve and has a first ring mounted around the inner sliding sleeve and a spring mounted around the inner sliding sleeve and abutting the first ring.

The outer sliding sleeve is slidably mounted around the inner sliding sleeve and has an inner wall formed inside the outer sliding sleeve, an abutting block annularly formed on the inner wall of the outer sliding sleeve, a pressing surface, and a stopping surface. The pressing surface is formed on a side of the abutting block facing the inner sliding sleeve, and selectively pressing the engaging ball. The stopping surface is formed in an end of the abutting block and abuts an end of the spring at a position opposite to the first ring.

Other objectives, advantages and novel features of the present invention will become more apparent from the following detailed description when taken in conjunction with the accompanying drawings.

DETAILED DESCRIPTION OF PREFERRED EMBODIMENT

Figure 1:
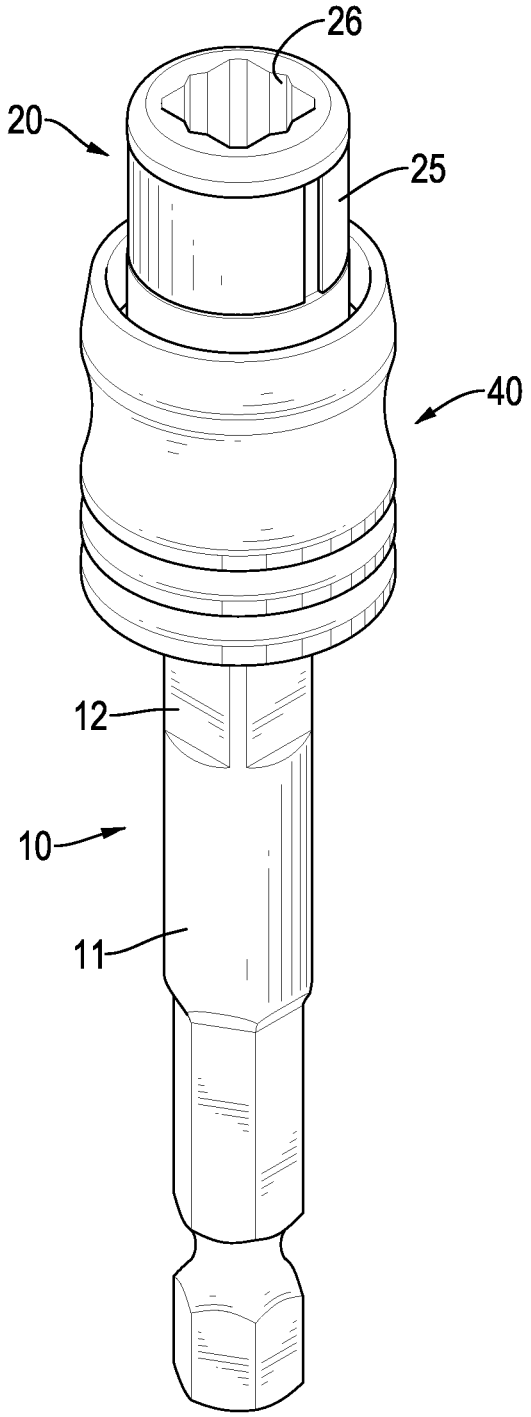
FIG. 1 is a perspective view of a preferred embodiment of a hand tool in accordance with the present invention.
Figure 2:
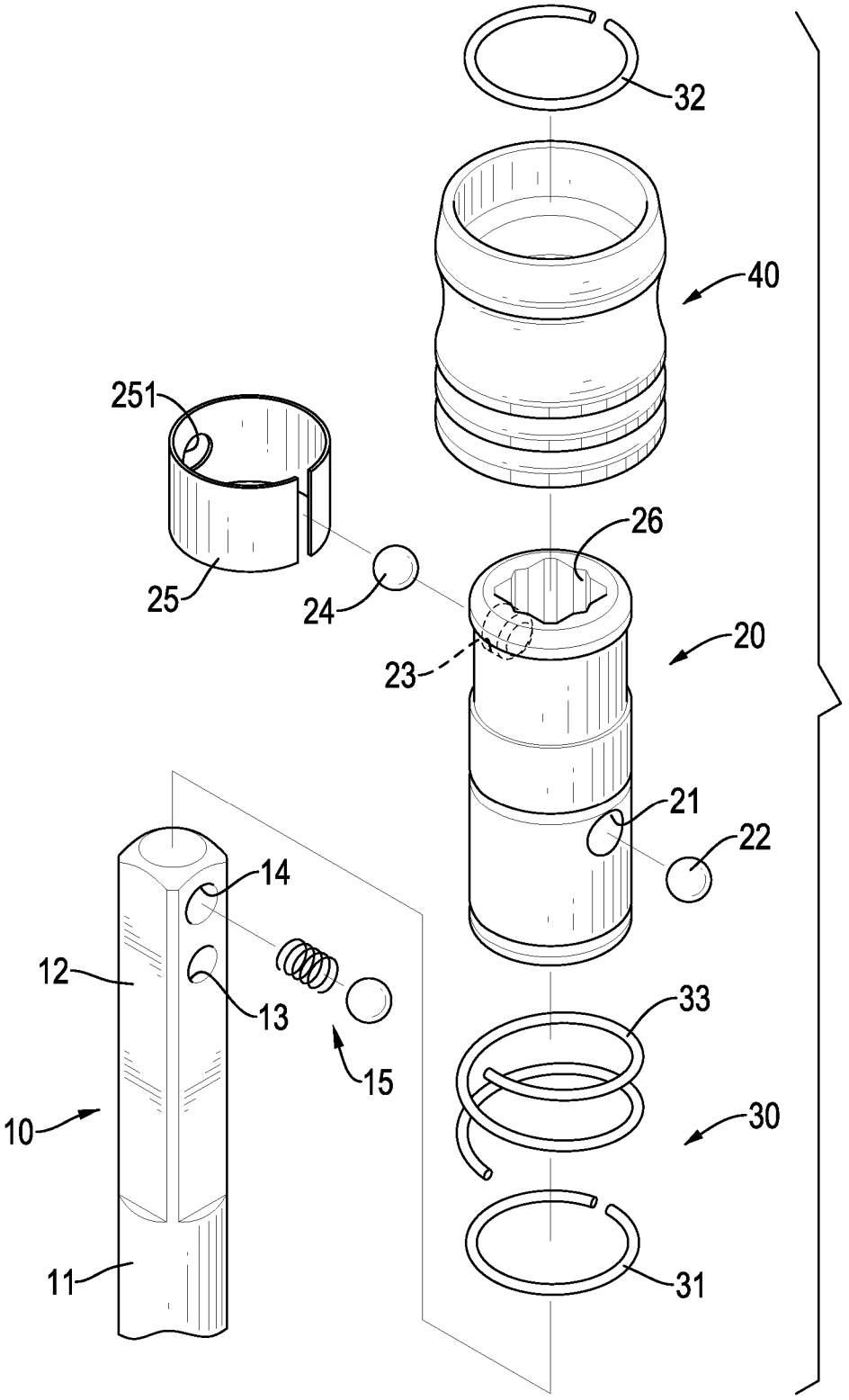
FIG. 2 is an exploded perspective view of the hand tool in FIG. 1.
Figure 3:
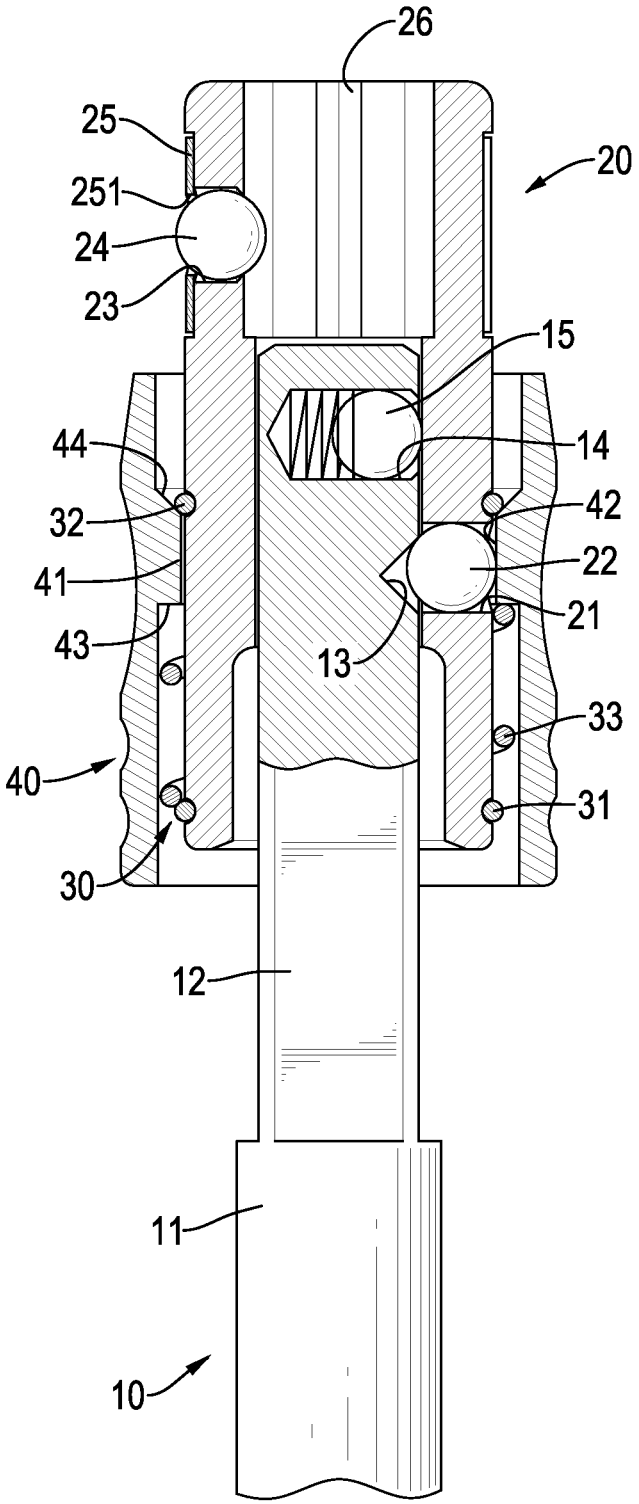
FIG. 3 is an enlarged side view in partial section of the hand tool in FIG. 1.

With the reference to FIGS. 1 to 3, a preferred embodiment of a hand tool in accordance with the present invention has a tool shaft 10, an inner sliding sleeve 20, an engagement module 30, and an outer sliding sleeve 40.

The tool shaft 10 has an operating segment 11, a working segment 12, an engaging recess 13, and an engagement unit recess 14 and an engagement unit 15. The operating segment 11 may be applied for being held by a user, or may be applied for connecting with a handle for the tool shaft 10. The working segment 12 has a square outer cross section, and is connected with the operating segment 11. The engaging recess 13 and the engagement unit recess 14 are recessed in the working segment 12. The engagement unit 15 is mounted in the engagement unit recess 14 and protrudes from the engagement unit recess 14.

The inner sliding sleeve 20 is slidably mounted around the working segment 12 and is selectively positioned relative to the working segment 12. The inner sliding sleeve 20 has a square inner cross section that matches the outer cross section of the working segment 12. The inner sliding sleeve 20 further has an engaging hole 21, an engaging ball 22, an abutting hole 23, an abutting ball 24, a sleeve buckle 25, and four slits 26. The engaging hole 21 is formed through the inner sliding sleeve 20 and is selectively aligned with the engaging recess 13. The engaging ball 22 is moveably mounted in the engaging hole 21. When the engaging hole 21 is aligned with the engaging recess 13, the engaging ball 22 is slid into and engaged with the engaging recess 13, such that a position of the inner sliding sleeve 20 relative to the tool shaft 10 is fixed. The abutting hole 23 is formed through the inner sliding sleeve 20 and is adjacent to an end of the inner sliding sleeve 20. The abutting ball 24 is moveably mounted in the abutting hole 23. The sleeve buckle 25 is mounted around the inner sliding sleeve 20 and has a radial elasticity relative to the inner sliding sleeve 20. The abutting ball 24 protrudes out of the sleeve buckle 25. The sleeve buckle 25 may be an elastic ring or a spring. Preferably, the sleeve buckle 25 is an elastic ring and has a ball hole 251 formed through the sleeve buckle 25 at a position corresponding to the abutting ball 24. The abutting ball 24 protrudes from the ball hole 251. The slits 26 are longitudinally recessed in an inner wall of the inner sliding sleeve 20 and are respectively located at four sides of the inner wall of the inner sliding sleeve 20. Therefore, the inner sliding sleeve 20 can be connected with a square tool adapter and a hexagonal tool adapter.

The engagement module 30 is mounted around the inner sliding sleeve 20 and has a first ring 31, a second ring 32 and a spring 33. The first ring 31 is mounted around the inner sliding sleeve 20 at a position away from the abutting hole 23. The second ring 32 is mounted around the inner sliding sleeve 20. The spring 33 is mounted around the inner sliding sleeve 20 and is located between the first ring 31 and the second ring 32. The spring 33 abuts the first ring 31 by one of two ends of the spring 33 to keep the spring 33 from detaching from the inner sliding sleeve 20.

The outer sliding sleeve 40 is slidably mounted around the inner sliding sleeve 20 and has an abutting block 41, a pressing surface 42, a stopping surface 43 and an abutting surface 44. The abutting block 41 is annularly formed on an inner wall of the outer sliding sleeve 40. The pressing surface 42 is formed on a side of the abutting block 41 facing the inner sliding sleeve 20, and selectively presses the engaging ball 22. The stopping surface 43 is formed in an end of the abutting block 41 and abuts one of the ends of the spring 33 at a position opposite to the first ring 31. The abutting surface 44 is formed in another end of the abutting block 41 at a position opposite to the stopping surface 43, and selectively abuts the second ring 32.

Figure 4:
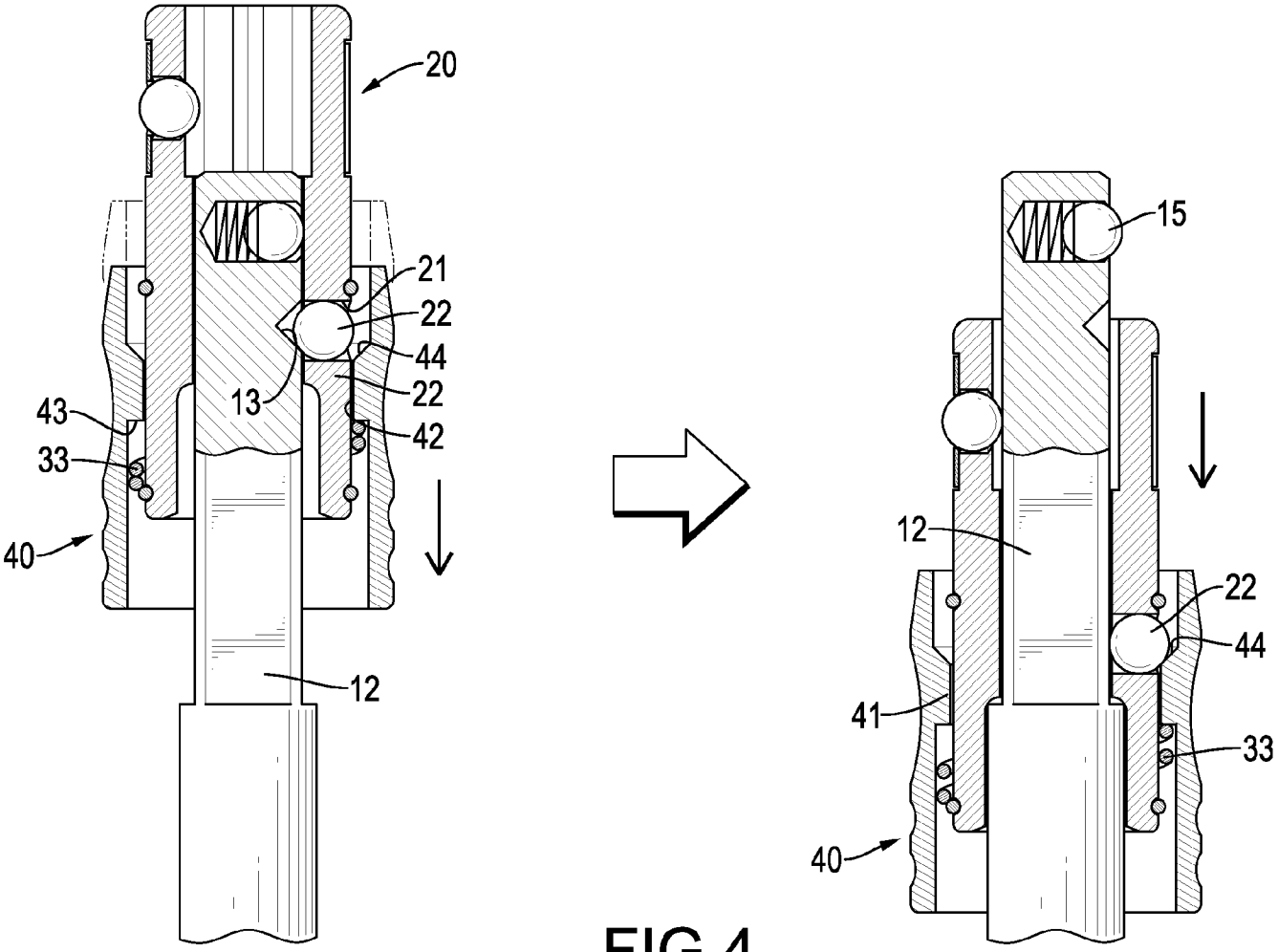
FIG. 4 shows operational side views in partial section of the hand tool in FIG. 1.

With reference to FIGS. 3 and 4, when the outer sliding sleeve 40 is slid relative to the inner sliding sleeve 20, the stopping surface 43 presses the spring 33, and the engaging ball 22 is not pressed by the pressing surface 42. Then, the engaging ball 22 can be detached from the engaging recess 13 and protrudes out from the engaging hole 21. Then, after the inner sliding sleeve 20 is slid relative to the tool shaft 10, a part of the engaging ball 22 that protrudes out of the engaging hole 21 abuts the abutting surface 44, such that the outer sliding sleeve 40 can be moved at the same time. The inner sliding sleeve 20 can be slid until the inner sliding sleeve 20 abuts a connecting junction between the operating segment 11 and the working segment 12. The abutting block 41 is positioned between the spring 33 and the engaging ball 22, such that the outer sliding sleeve 40 can be fixed relative to the inner sliding sleeve 20. Therefore, the tool shaft 10 protrudes out of the inner sliding sleeve 20, and the engagement unit 15 is exposed. The working segment 12 can be connected with an inner square tool adapter, wherein the engagement unit 15 can press the inner square tool adapter tightly to keep the inner square tool adapter from detaching from the working segment 12.

Figure 5:
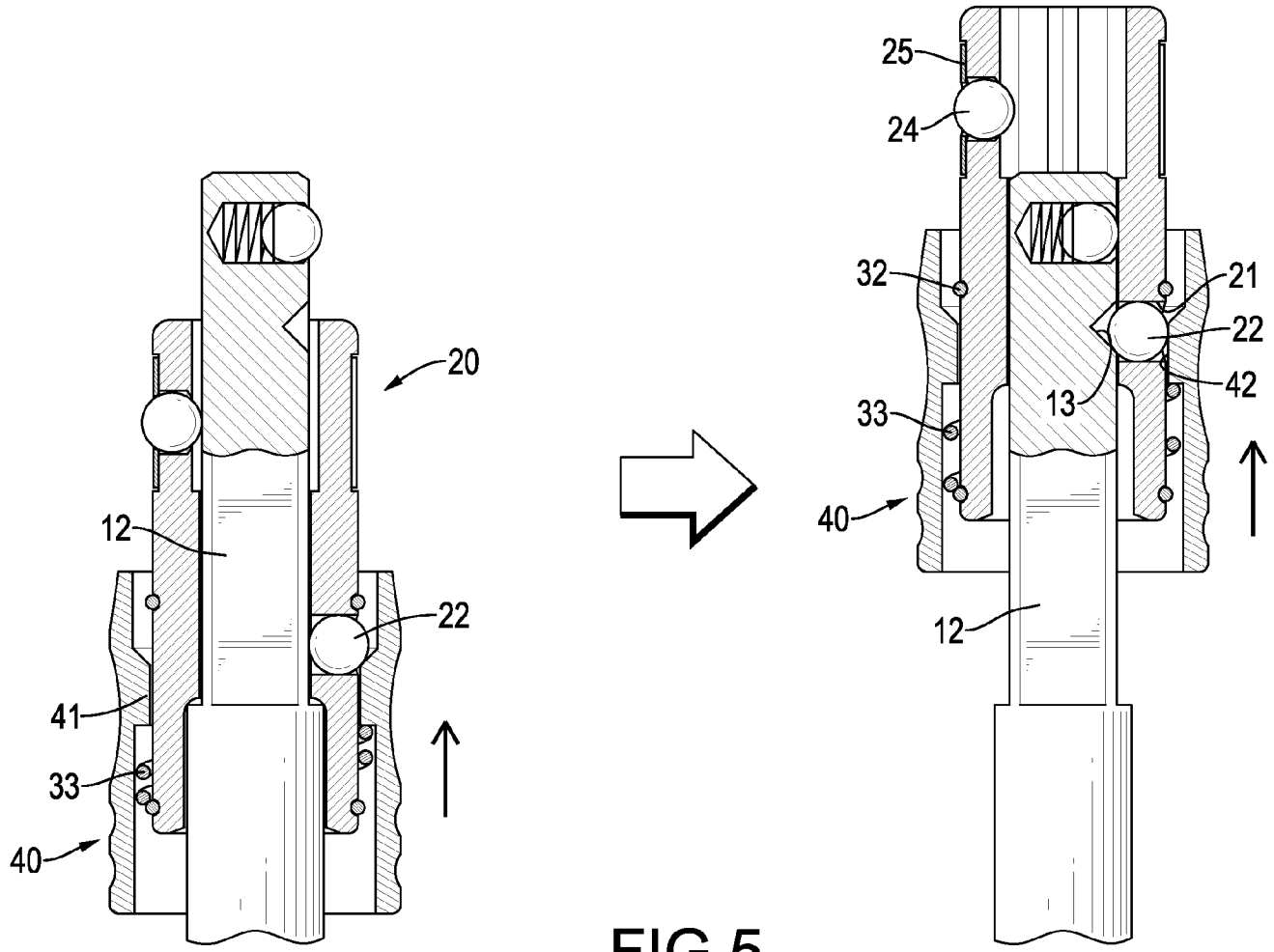
FIG. 5 shows other operational side views in partial section of the hand tool in FIG. 1.

With reference to a right half of FIG. 4 and FIG. 5, when the inner sliding sleeve 20 (or the outer sliding sleeve 40) is pulled relative to the tool shaft 10, the inner sliding sleeve 20 and the outer sliding sleeve 40 can be moved relative to the tool shaft 10 at the same time since the inner sliding sleeve 20 and the outer sliding sleeve 40 are engaged with each other.

With reference to FIGS. 3 and 5, after the inner sliding sleeve 20 is pulled relative to the tool shaft 10, the engaging hole 21 is aligned with the engaging recess 13 and the engaging ball 22 is pressed into the engaging recess 13 by the pressing surface 42. The abutting block 41 is pressed by the spring 33 to hold the outer sliding sleeve 40 in position relative to the inner sliding sleeve 20. When the abutting block 41 is at a position between the first ring 31 and the second ring 32, the position of the outer sliding sleeve 40 relative to the inner sliding sleeve 20 is fixed. Accordingly, the inner sliding sleeve 20 protrudes out of the tool shaft 10 and the inner sliding sleeve 20 can be connected with a hexagonal tool adapter or a square tool adapter. The abutting ball 24 can abut the tool adapter tightly to keep the tool adapter from detaching from the inner sliding sleeve 20.

From the above description, it is noted that the present invention has the following advantages:

1. When the inner sliding sleeve 20 is slid to protrude out of the tool shaft 10, the engaging ball 22 (engaged between the engaging recess 13 and the engaging hole 21) can position the inner sliding sleeve 20 relative to the tool shaft 10 to keep the inner sliding sleeve 20 from retracting relative to the tool shaft 10.

On the other hand, the outer sliding sleeve 40 is pressed along the tool shaft 10, and the engaging ball 22 is not pressed by the pressing surface 42, such that the engaging ball 22 can detach from the engaging recess 13. Consequently, the inner sliding sleeve 20 is retracted relative to the tool shaft 10, and the outer sliding sleeve 40 is also moved relative to the tool shaft 10 since the engaging ball 22 presses the abutting block 41.

2. When the inner sliding sleeve 20 is retracted relative to the tool shaft 10, the working segment 12 can be connected with the tool adapter tightly by the engagement unit 15.

3. The second ring 32 can keep the outer sliding sleeve 40 from detaching from the inner sliding sleeve 20. When the working segment 12 is retracted relative to the inner sliding sleeve 20, the inner sliding sleeve 20 can be connected with the tool adapter tightly by the abutting ball 24. Furthermore, the inner sliding sleeve 20 can be connected with the hexagonal tool adapter by the slits 26.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hand tool having:

a tool shaft having a working segment having a square outer cross section; and an engaging recess formed in the working segment;

an engagement unit recess recessed in the working segment; and an engagement unit mounted in the engagement unit recess and protruding from the engagement unit recess;

an inner sliding sleeve slidably mounted around the working segment, selectively positioned relative to the working segment, and having a square inner cross section that matches the outer cross section of the working segment;

an engaging hole formed through the inner sliding sleeve and selectively aligned with the engaging recess; and an engaging ball moveably mounted in the engaging hole; and four slits longitudinally recessed in an inner wall of the inner sliding sleeve and respectively located at four sides of the inner wall of the inner sliding sleeve;

an engagement module mounted around the inner sliding sleeve and having a first ring mounted around the inner sliding sleeve; and a second ring mounted around the inner sliding sleeve; and a spring mounted around the inner sliding sleeve and abutting the first ring; and an outer sliding sleeve slidably mounted around the inner sliding sleeve and having an inner wall formed inside the outer sliding sleeve;

an abutting block annularly formed on the inner wall of the outer sliding sleeve;

a pressing surface formed on a side of the abutting block facing the inner sliding sleeve, and selectively pressing the engaging ball; and a stopping surface formed in an end of the abutting block and abutting an end of the spring at a position opposite to the first ring; and an abutting surface formed in another end of the abutting block at a position opposite to the stopping surface and selectively abutting the second ring.

2. The hand tool as claimed in claim 1, wherein the inner sliding sleeve further has an abutting hole formed through the inner sliding sleeve;

an abutting ball moveably mounted in the abutting hole; and a sleeve buckle mounted around the inner sliding sleeve and having a radial elasticity relative to the inner sliding sleeve.

3. The hand tool as claimed in claim 2, wherein the sleeve buckle is an elastic ring and has a ball hole formed through the sleeve buckle at a position corresponding to the abutting ball, wherein the abutting ball protrudes from the ball hole.

* * * * *